United States Patent [19]

Chisholm et al.

[11] Patent Number: 4,782,538

[45] Date of Patent: Nov. 8, 1988

[54] RESERVOIRS

[76] Inventors: Donald Chisholm; David McPherson, both of 3327 Pacific Highway, Springwood, Qld. 4127, Australia

[21] Appl. No.: 888,978

[22] Filed: Jul. 23, 1986

[30] Foreign Application Priority Data

Jul. 23, 1985 [AU] Australia ..... PH01597

[51] Int. Cl.[4] ..... E04H 3/16; E04H 3/18

[52] U.S. Cl. ..... 4/506; 4/488; 52/146; 52/169.7

[58] Field of Search ..... 4/506, 488, 507; 52/169.7, 146, 245

[56] References Cited

U.S. PATENT DOCUMENTS 1,786,613 12/1930 Hooper ..... 4/506 X
3,256,532 6/1966 Lindsay et al. ..... 4/506 X
3,315,278 4/1967 Schatzki et al. ..... 4/506 X
3,335,430 8/1967 Schwarz et al. ..... 4/506
3,409,916 11/1968 Billig et al. ..... 52/146
3,648,301 3/1972 Wiley ..... 4/506

*Primary Examiner*—Henry K. Artis
*Attorney, Agent, or Firm*—McAulay, Fields, Fisher, Goldstein & Nissen

[57] ABSTRACT

A reservoir assembly (10) which has transversely extending frame assemblies (11) which support opposed side walls (12/12*a*). The frame assemblies (11) each have wall supporting members (15) integral with a relatively lightweight base member (16) which extends beneath the bottom wall of the reservoir. A pressure pad (18) disposed centrally above the base member (16) and beneath the bottom wall prevents upward buckling of the base member (16).

20 Claims, 4 Drawing Sheets

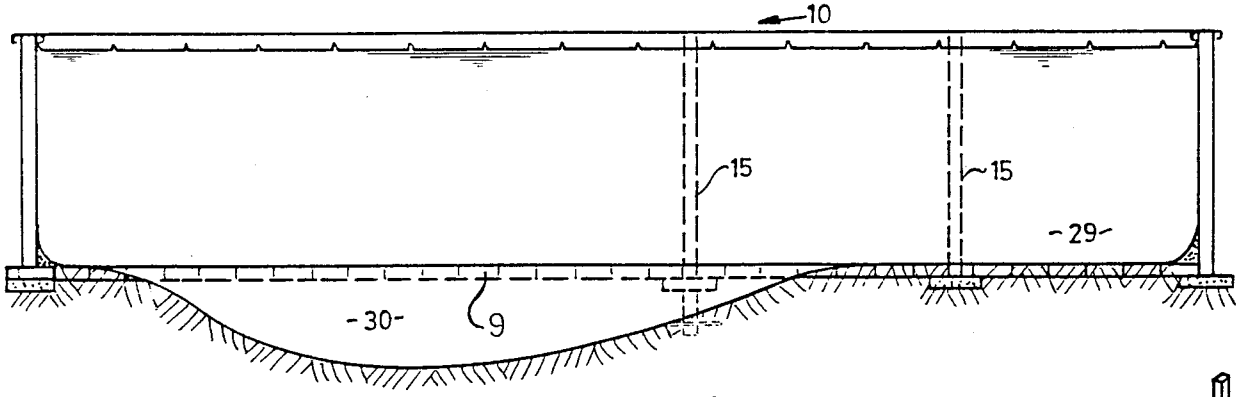
FIG. 3
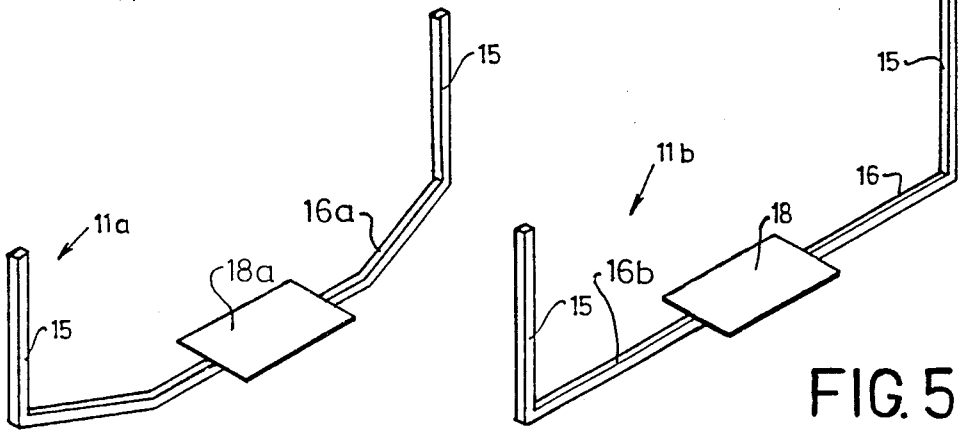
FIG. 4
FIG. 5

RESERVOIRS

This invention relates to improvements in and relating to reservoirs.

This invention is particularly applicable to above ground swimming pools and reference hereinafter will be made to such pools. However it is to be understood that this invention can be applied to inground swimming pools and other types of reservoirs as desired.

In recent years above ground pools have become available in relatively large sizes and in shapes other than circular. In the larger sizes, the non-circular pools generally have spaced elongate side walls interconnected by semi-circular end walls. In order to resist buckling of the elongate side walls they are supported by posts which may be either set or concreted into the ground or supported on the ground and provided with external braces which may require secure concrete footings.

A major attraction of such pools is that they are relatively inexpensive when compared to conventional inground pools and may be dismantled and re-erected in a different location. However the cost advantage of such pools reduces with the complexity of, or time required to erect the wall supports. Generally large pools require more expensive and sophisticated wall support systems than small circular pools. Furthermore if the wall system includes posts which are set into the ground, the pool may be difficult to erect and dismantle. If external bracing is used it protrudes into the area adjacent the pool and is a hazard for persons using the pool.

This invention aims to alleviate the abovementioned disadvantages and to provide improvements in and relating to above ground reservoirs which will be reliable and efficient in use. Other objects and advantages of this invention will hereinafter become apparent.

With the foregoing and other objects in view, this invention in one aspect resides broadly in a reservoir assembly of the type having a base wall, a side wall and support means for supporting a portion of said side wall, characterised in that said support means includes a base member extending beneath said base wall and a wall supporting member supported by said base member, the latter having a bearing surface upon which the weight of reservoir water thereabove will prevent said base member moving upwardly to a significant extent. The latter may be provided with a pressure pad remote from said wall support means whereby the weight of water above said pressure pad may be utilized to retain the base member operatively beneath the base wall. Each frame assembly may be L-shaped, having a base member adapted to extend beneath the reservoir and an upstanding wall support member but in the preferred form the frame assembly is U-shaped and has a base member which extends beneath the reservoir between opposed side walls thereof and respective wall support members at the opposite ends of said base member.

Preferably the base member and wall supporting members are formed from similar section metal tubes, such as hollow rectangular tubes and preferably each support means is fabricated as an integral one-piece unit. Of course the base and wall supporting members could be detachable if required.

This invention also resides in support means for a reservoir as defined above and having base members and wall support members which are preferably formed integrally with the base members.

In another aspect this invention resides in a method of erecting a reservoir of the type defined above, including placing the required support means in their operative positions on or in a bed of particulate material such as sand, dirt or gravel or the like as desired, forming bearing surfaces on said base members and supporting the base wall of said reservoir above said bearing surfaces for partial support thereby. The bearing surfaces may be constituted by pressure pads which may be separate from or integral with the frame assemblies or be constituted by said frame assemblies.

In order that this invention may be more readily understood and put into practical effect, reference will now be made to the accompanying drawings which illustrate typical above ground pools made in accordance with the present invention, wherein:

FIG. 3 is a cross-sectional view of the pool;

FIGS. 4 and 5 are perspective views of frame assemblies for supporting the pool wall;

Figure 1:
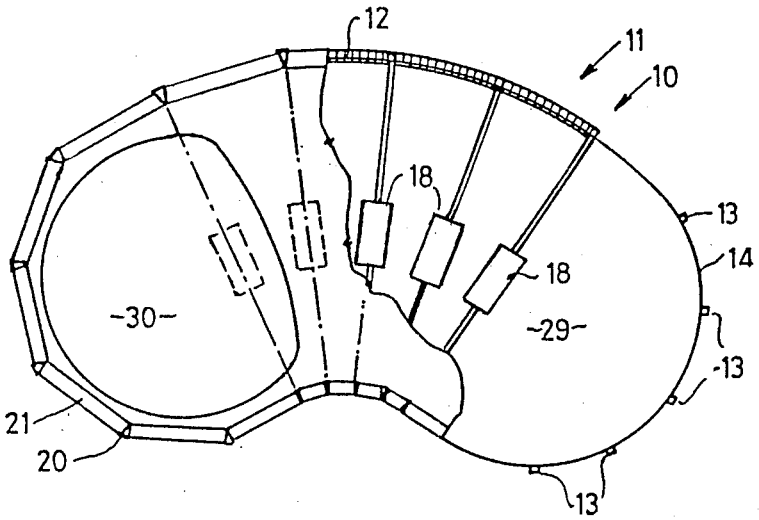
FIG. 1 is a broken away plan view of a kidney shaped pool.
Figure 2:
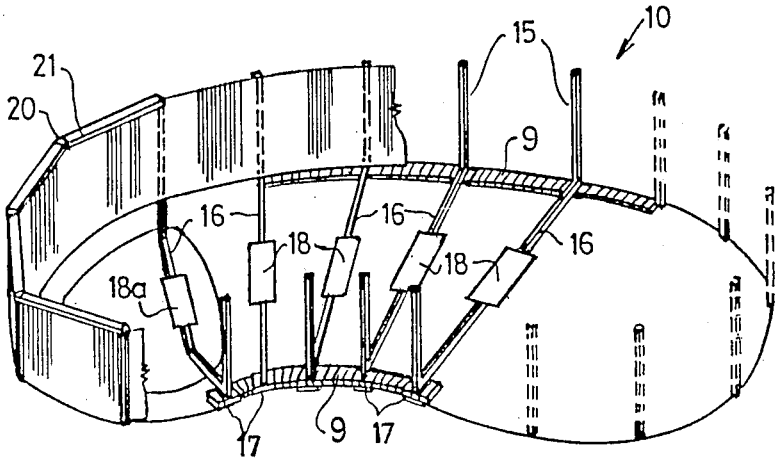
FIG. 2 is a perspective view of a partly completed pool.

As shown in the drawings, the kidney shaped pool assembly 10 includes transverse frame assemblies 11 which support the curved side walls 12 of the pool and end posts 13 which support the opposed semi-circular end walls 14. As the end walls 14 have a relatively small radius of curvature they are substantially self supporting such that the end post 13 do not require external bracing in the form of inclined struts or the like. However the side walls and in particular the elongate wall 12 has a relatively large radius of curvature and thus it requires external support to prevent it from buckling. This is provided by the transversely extending frame assemblies 11, as shown in FIGS. 4 and 5; which converge from the wall 12 towards the internally curved wall **12*a***.

Each transverse frame assembly 11 is provided with spaced upright wall supporting members 15 integral with a continuous floor rail or base member 16 interconnecting and supporting the uprights 15. At the shallow end 29 of the pool 10, the rail 16 is straight at portion **16*b* as shown in FIG. 5, while at the deep end 30, the rail 16 is bowed downwardly at portion 16*a* as shown in FIG. 4. Each rail 16 is disposed beneath the waterproof liner 28. The frame assemblies 11 are supported at each end on suitable load bearing pads 17, such as paving blocks, and a sand infill is formed to support the liner 28 above rails 16*a* and 16*b*. Further blocks 9 or a concrete slab are located between the frame ends above the bearing pads 17 to maintain the frames 11** in position.

In order to minimise the cost and weight of the frame assemblies 11, each is fabricated from lightweight hollow rectangular section metal tubing. The span of each rail 16 between the support pads 17 is relatively large and a significant buckling load is applied to each rail 16 through the integral wall supporting uprights 15. Thus there is a tendency for the rails 16 to buckle upwardly intermediate the supporting pads 17. Such buckling if present would allow the pool walls to move out of plumb and the floor liner 28 would be lifted along each rail 16. This would be unsightly and the lifted portions could be easily ruptured.

In the present invention such buckling is prevented or significantly reduced by placing a pressure plate 18 of sufficient area above the center portion of the rail 16 whereby in use, the weight of the column of water above the plate 18 will counteract such upward buckling tendency of the rail so as to maintain the uprights 15 in their operative attitude. The pressure plates 18 also spread any bowing of the rails 16 across a relatively large area of the base wall such that the slight bowing which may occur becomes insignificant.

The plates 18 may be welded to the rails 16 or otherwise located thereon but preferably they are simply placed above the rails 16 and the bedding sand or the like in which the rails 16 are supported is used to cover the rails 16 and pads 18 prior to the base and side wall liner 28 being placed in position above the rails 16. The remainder of the pool may be of substantially conventional construction such as is illustrated in FIG. 6.

Figure 6:
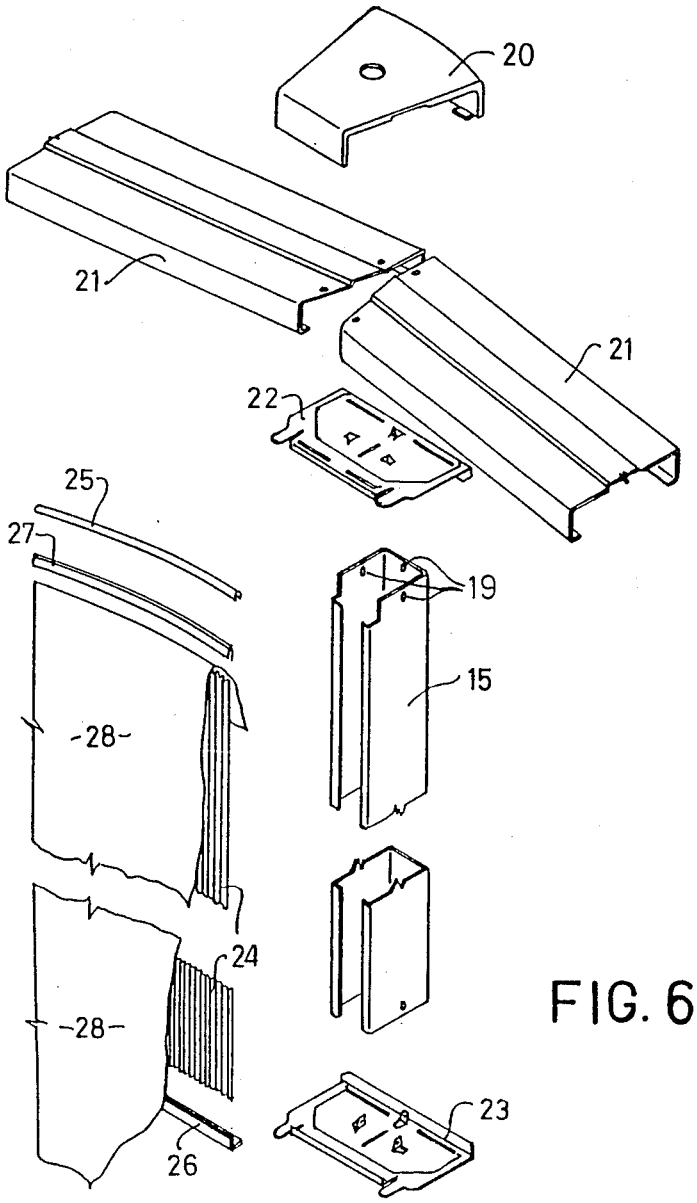
FIG. 6 illustrates a typical pool wall construction.

As shown in FIG. 6, the upper ends of the uprights 15 are apertured at 19 to enable the coping 20 to be connected thereto. These are used together with their adaptor plates 22 to interconnect the coping sections 21 to form a top beam surrounding the top edge of the pool wall 24 which is formed from suitable corrugated sheet metal. The lower end of the posts 13 are supported on bottom plates 23. The upper and lower edges of the wall 24 are connected to curved rails 25 and 26 which extend continuously around the wall and connect to the top and bottom adaptor plates 22 and 23. A protective edging strip 27 is used to secure the liner 28 about the top edge of the wall 24.

The plates 18 may be formed from flat steel plate or from corrugated material arranged with the corrugations extending transversely to the rails 16. The frames 11 could be formed of hollow or solid material or in the form of a truss assembly and from any suitable material such as steel, aluminium or a reinforced plastics material. Typically a pressure plate of approximately 600 mm×300 mm may be suitable for a rail span of about 5000 mm. Of course the size of the pressure plate will vary with the height and width of the reservoir and with the size and type of material used to form the frame assemblies 11. Furthermore the size of the frame members and the area of the pressure plates may be varied to suit the particular load conditions.

Figure 7:
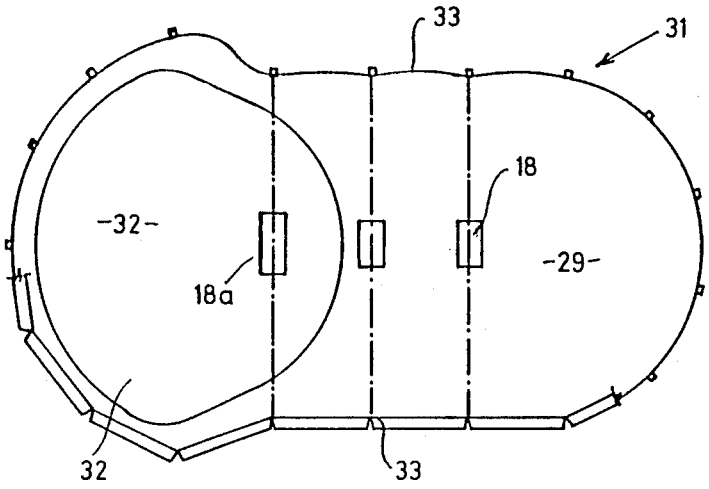
FIGS. 7 and 8 are broken away plan views illustrating further pool shapes.
Figure 8:
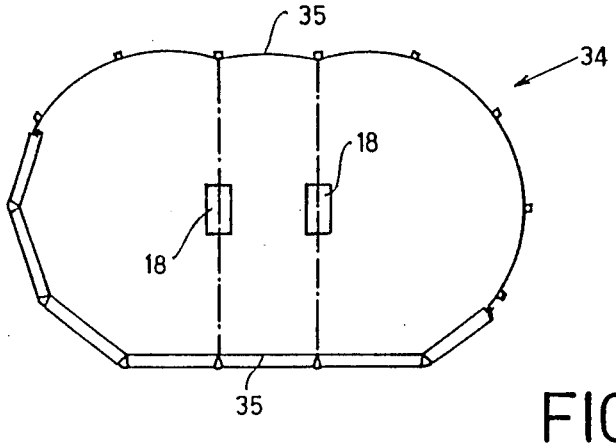

In the pool 31 shown in FIG. 7 the pressure plate **18*a* used for frame 11 at the deep end 32 is larger than the pressure plates 18 used for the remaining frames 11 which extend between the sidewalls 33. The extra area of the plate 18*a* is required at the deep end because of the reversal in wall curvature whereby a greater buckling load is imposed on the frame at that position. Of course the pool can be formed to a uniform depth as shown in FIG. 8. In this embodiment the pool 34 is provided with two identical frames 11 extending between the sidewalls 35 and associated pressure pads 18**.

The above described pool constructions may be used for below ground pools. For this purpose, a pool shaped excavation is formed which is larger than the pool and the pool is erected in the excavation. It is then filled with water and the space between the pool walls and the excavation walls is backfilled with concrete.

From the above it will be seen that the present invention provides a transportable pool assembly which will be economical to transport, simple to erect and effective in use. As all components are prefabricated erection can proceed quickly by levelling the site, placing the support pads 17 at the appropriate levels and then supporting the frames 11 on these pads. Thereafter the pool walls can be erected and the liner and coping placed in conventional mamner.

It will of course be realised the above has been given only by way of illustrative example of the present invention and that all such modifications and variations thereto as would be apparent to persons skilled in the art are deemed to fall within the broad scope and ambit of this invention as is defined in the appended claims.

The claims defining the invention are claimed as follows:

1. A reservoir assembly free of external supporting braces having a base wall, a side wall and support means for supporting said side wall, and an end wall having a smaller radius of curvature than said side wall, whereby said end wall is substantially self supporting and is free of external bracing, said support means including a U-shaped supporting frame extending across said reservoir to support opposed portions of said side wall, said supporting frame being free of external bracing and having a base member in the form of a continuous beam formed integrally with the lower ends of opposed cantilevered wall supporting members whereby said beam resists outward splaying of said wall supporting members, said base member extending beneath said base wall such that the weight of the reservoir water applied through said base wall to said base member reduces upward deflection of the central portion of said base member and thus outward splaying of said cantilevered wall supporting members to a significant extent.

2. The reservoir assembly according to claim 1, wherein said lower ends of said wall supporting members and said base member have a constant cross-sectional configuration.

3. The reservoir assembly according to claim 1, wherein there are provided a plurality of said U-shaped supporting frames.

4. The reservoir assembly according to claim 2, wherein said base member is bedded into particulate material and is supported on bearing pads beneath each said lower ends.

5. A reservoir assembly according to claim 4, wherein there is provided a pressure pad between said flexible base wall and said base member adjacent the center of said base member.

6. A reservoir assembly according to claim 5, wherein the depth of said reservoir varies and said pressure pads for said U-shaped supporting frames at deep sections have a larger bearing surface than said pressure pads on supporting frames at shallow sections.

7. The reservoir assembly according to claim 1, including at least two of said U-shaped supporting frames, external of said base wall and said side wall.

8. The reservoir according to claim 1, including load bearing pads beneath each said lower ends.

9. The reservoir assembly according to claim 1, including a pressure pad between said flexible base wall and said base member adjacent to the center of each said base member.

10. The reservoir assembly according to claim 1, including a pressure pad between said flexible base wall and said base member adjacent the center of said base member.

11. The reservoir assembly according to claim 4, including at least two of said U-shaped supporting frames, external of said base wall and said side wall.

12. The reservoir assembly according to claim 2, wherein said pressure pad is welded to said supporting frame.

13. A method of erecting a reservoir as defined in claim 1, including supporting the base wall of said reservoir solely by said wall supporting members.

14. A method of erecting a reservoir free of external bracing having a flexible base wall, a flexible side wall, a support for supporting the side wall, and an end wall having a smaller radius of curvature than said side wall, whereby said end wall is substantially self supporting and is free of external bracing, including solely a U-shaped supporting frame free of external bracing extending across the reservoir to support opposed portions of the side wall, the supporting frame having at least one base member in the form of a continuous beam formed integrally with the lower ends of opposed cantilevered wall supporting members whereby the beam resists outward splaying of the wall supporting members, and the at least one base member extends beneath the flexible base wall, including:

arranging only the required U-shaped supporting frames in their operative positions in a bed of particulate material; and placing pressure plates onto the base members.

15. The method of erecting the reservoir according to claim 14, including placing the flexible base wall onto the pressure plates and supporting the base wall of the reservoir by the wall supporting members, whereby the weight of the reservoir water applied through the flexible base wall to the base member reduces upward deflection of the central portion of the base member and thus outward splaying of the cantilevered wall supporting members to a significant extent.

16. The method of erecting the reservoir according to claim 15, including welding the pressure plates to the base members.

17. The method of erecting the reservoir according to claim 15, wherein the bearing surfaces are constituted by pressure pads formed integral with the frame assemblies.

18. The reservoir according to claim 1, wherein said side wall is free of external bracing.

19. The reservoir according to claim 6, wherein said side wall is also free of external bracing.

20. The method according to claim 14, wherein said side wall is also free of external bracing.

* * * * *